US010443841B2

(12) United States Patent
Fitzsimmons

(10) Patent No.: US 10,443,841 B2
(45) Date of Patent: Oct. 15, 2019

(54) METHODS AND DEVICES FOR EVEN DISTRIBUTION OF SOLID FUEL MATERIALS

(71) Applicant: GAS TECHNOLOGY INSTITUTE, Des Plaines, IL (US)

(72) Inventor: Mark Fitzsimmons, Reseda, CA (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 137 days.

(21) Appl. No.: 15/617,011

(22) Filed: Jun. 8, 2017

(65) Prior Publication Data

US 2017/0356644 A1 Dec. 14, 2017

Related U.S. Application Data

(60) Provisional application No. 62/347,283, filed on Jun. 8, 2016.

(51) Int. Cl.

| | |
|---|---|
| ***F23D 1/00*** | (2006.01) |
| ***F23N 1/00*** | (2006.01) |
| ***F23K 3/02*** | (2006.01) |
| ***F23C 10/00*** | (2006.01) |
| ***F23C 10/12*** | (2006.01) |
| ***F23C 10/22*** | (2006.01) |

(52) U.S. Cl.

CPC ..... *F23N 1/007* (2013.01); *F23C 10/002* (2013.01); *F23C 10/12* (2013.01); *F23C 10/22* (2013.01); *F23K 3/02* (2013.01); *F23C 2900/10004* (2013.01); *F23K 2203/202* (2013.01)

(58) Field of Classification Search

CPC ..... F23D 1/005

See application file for complete search history.

(56) References Cited

U.S. PATENT DOCUMENTS

| | | | | |
|---|---|---|---|---|
| 1,551,643 A | | 9/1925 | Crites et al. | |
| 3,204,942 A | * | 9/1965 | Matthys | B65G 53/528 110/104 R |
| 4,569,486 A | * | 2/1986 | Balmer | A01M 9/003 239/166 |
| 4,593,630 A | * | 6/1986 | Teigen | B01J 8/0015 110/101 R |
| 4,823,712 A | | 4/1989 | Wormer | |

(Continued)

OTHER PUBLICATIONS

Co-pending U.S. Appl. No. 15/235,619, Fitzsimmons, "Fluidized Bed Combustion of Carbonaceous Fuels", filed Aug. 12, 2016.

(Continued)

*Primary Examiner* — Nathaniel Herzfeld

(74) *Attorney, Agent, or Firm* — Pauley Erickson & Kottis

(57) ABSTRACT

Methods, devices and systems for processing of solid materials, particularly fuel material solids such as carbonaceous fuel solids such as of granular form, to provide or result in an even distribution of the solid material. Hoppers are provided with plurality of outlet orifices, each of the outlet orifices adapted to flow therethrough a combination of gas and the solid material to pneumatically convey the solid material to a distribution manifold. The distribution manifold includes a plurality of tubes with each tube having a plurality of exit orifices wherein each exit orifice passes an equal portion of the combination of the gas and the solid material.

14 Claims, 7 Drawing Sheets

(56) References Cited

U.S. PATENT DOCUMENTS 4,832,539 A * 5/1989 Wolfe ..... B65G 53/528 266/182
4,932,594 A 6/1990 Kim
5,048,761 A * 9/1991 Kim ..... B65G 53/66 110/265
5,114,078 A 5/1992 Takata
5,868,083 A * 2/1999 Brannstrom ..... B65G 53/20 110/243
6,220,790 B1 * 4/2001 Schenk ..... B65G 53/528 141/236
6,418,866 B1 * 7/2002 Shimizu ..... F23C 10/28 110/347
7,524,146 B2 * 4/2009 Peet ..... B65G 53/66 406/10
9,567,876 B2 2/2017 Stewart et al.
2003/0209470 A1 11/2003 Wark
2006/0056924 A1 * 3/2006 Jurkovich ..... B65G 53/66 406/39
2008/0295647 A1 * 12/2008 Kwon ..... C10J 3/20 75/436
2010/0307389 A1 12/2010 Stewart et al.
2013/0140168 A1 * 6/2013 Koyama ..... B65G 53/18 202/261
2014/0065559 A1 3/2014 Jukkola
2016/0208659 A1 7/2016 Stewart et al.
2019/0055485 A1 * 2/2019 Kasai ..... C10J 3/30

OTHER PUBLICATIONS

PCT International Search Report, Form PCT/ISA/210, dated Aug. 16, 2017, (2 pages).
PCT Written Opinion of the International Searching Authority, Form PCT/ISA/237, dated Aug. 16, 2017, (5 pages).

* cited by examiner

METHODS AND DEVICES FOR EVEN DISTRIBUTION OF SOLID FUEL MATERIALS

CROSS REFERENCE TO RELATED APPLICATION

This application claims the benefit of U.S. Provisional Patent Application, Ser. No. 62/347,283, filed on 8 Jun. 2016. The co-pending Provisional Application is hereby incorporated by reference herein in its entirety and is made a part hereof, including but not limited to those portions which specifically appear hereinafter.

The subject matter of this application is also related to prior U.S. patent application Ser. No. 12/794,218, filed on 4 Jun. 2010 (now U.S. Pat. No. 9,567,876, issued 14 Feb. 2017); Ser. No. 15/085,113, filed on 30 Mar. 2016; and Ser. No. 15/235,619, filed on 12 Aug. 2016. The disclosures of these related patent applications are hereby incorporated by reference herein and made a part hereof, including but not limited to those portions which specifically appear hereinafter.

BACKGROUND OF THE INVENTION

Field of the Invention

This invention relates generally to processing of solid materials, particularly fuel material solids such as carbonaceous fuel solids such as of granular form and, more specifically, to methods and devices for even distribution of such material solids over extended areas.

Discussion of Related Art

In recent years, such as due to concerns about global climate change, the atmospheric release of large quantities of $CO_2$ in conjunction with power generation has come under close scrutiny, and new power sources have been sought which reduce $CO_2$ emissions. A promising technology called oxy-combustion has been under development in many countries for more than a decade.

Such processing technology commonly employs a reactor consisting of a fluidized bed such as made up of an inert material or dolomite, or a combination of both. A solid carbonaceous, possibly sulfur-containing, fuel is injected into the reactor to be burned with oxygen or air. Recycled flue gas such as primarily composed of carbon dioxide and steam is used to fluidize the bed. $CO_2$ may constitute 65-99% of the fluidizing gas for the bed, and steam may make up the remainder. Conventional oxy-combustion reactors premix all recycled flue gas with 20-30% or as much as 50% oxygen (molar percentage). This is a common generic recipe for oxy-combustion systems which have been proposed for optimized high carbon capture systems for producing power from coal, petroleum coke and biomass combustion.

In current, state of the art oxy-combustion technology such processing occurs at atmospheric pressure, and oxygen percentages above 50% and even as high as 100% have been performed which show no evidence of heat exchanger fouling, however at higher pressures above 3 or 4 atmospheres, the oxygen partial pressure can begin to cause ash particle melting, particle agglomeration and fouling.

A considerable amount of heat can be removed during flue gas water condensation if the process is carried out at high pressure, which allows more electrical power to be produced with high quality steam, and boiler feedwater can be preheated with the flue gas condensate. Therefore, a method of performing oxy-combustion at high pressure is highly desired to improve the system efficiency.

One implication of performing oxy-combustion in the conventional method described above but at high pressure is that the high oxygen content requires that carbonaceous fuel (such as coal, lignite, petroleum coke or biomass) be injected at a large particle diameter to prevent overheating, and consequently solids have to be circulated outside the bed via cyclones to ensure complete combustion (US 2014/0065559 A1).

Injecting pulverized coal into such a bed as described in patent application US 2010/0307389 A1 will allow complete combustion in a very short time, such that solids do not have to be circulated outside the bed, however this also has a risk that coal particles will burn faster than the heat can be removed and diffuse through the bed to heat transfer surfaces, and this can lead to fouling through slagging agglomeration. Moisture in the fuel has only a limited degree of mitigating effect, and using wet fuel has other detrimental effects on operating cost (more oxygen must be produced, and the solids cannot be handled in a conventional manner when they are not dried.)

In pressurized oxy-combustion, the problem of delivering the solid carbonaceous fuel (e.g., coal) and oxygen together requires that across a very large area of a fluidized bed, a large amount of coal will have to be distributed evenly.

One of the problems commonly associated with achieving desired fuel distribution in oxy-combustion processing is the inherent temperature of devolatization of the fuel. Each fuel will release hydrocarbons at elevated temperatures, and these tend to make the fuel sticky, and will rapidly plug pipes. The distribution method desirably must allow for fuel to be transported up to 20 or 30 feet across the diameter of a combustor without raising the temperature of the fuel up to devolatization temperatures.

Moreover, while distribution of the solid carbonaceous fuel (e.g., coal) across a very large area of a fluidized bed can be done relatively easily with existing designs if there is only one stage and fuel is delivered only to the bottom or the top of the bed, in a design for a compact pressurized fluidized bed combustor (PFBC) with finely pulverized coal, even distribution of the fuel must be done in successive stages, where existing manifold and distributor designs do not work. Coal must be distributed across a large surface with only 4.7-8.3 $MWth/m^2$ (preferably about 6 $MWth/m^2$). This requires about 2-4 injectors per square meter, coal feeders of about 1" and orifices of about ¼ to ½ inch diameter. These feeders must be insulated from the combustion environment to prevent caking and plugging.

While other developments have been directed to specified designs for injecting coal and oxygen together, there remains a need for methods, devices and systems that permit and facilitate desired distribution of solid materials, particularly fuel material solids such as carbonaceous fuel solids such as of granular form, e.g., solid carbonaceous fuel, such as coal, via system features such as manifolds and hoppers, for example, to corresponding or associated injectors.

BRIEF SUMMARY OF THE INVENTION

A general object of the subject development is to provide improved methods, devices and/or systems for processing of solid materials, particularly fuel material solids such as carbonaceous fuel solids such as of granular faun.

A more specific objective of the invention is to overcome one or more of the problems described above.

In accordance with one aspect of the subject development, there is provided a system for even distribution of a solid fuel material. In one embodiment, such a system includes a hopper provided with plurality of outlet orifices. Each of the outlet orifices is adapted to flow therethrough a combination of gas and the solid fuel material to pneumatically convey the solid fuel material to a distribution manifold. The distribution manifold serves to distribute an even flow of the solid fuel material over an extended distribution area. The distribution manifold includes a plurality of tubes with each tube having a plurality of exit orifices wherein each exit orifice passes an equal portion of the combination of the gas and the solid fuel material.

In accordance with another aspect of the subject development, there is provided a processing system that includes a staged fluidized bed reactor and an associated distribution system for even distribution of carbonaceous fuel to the staged fluidized bed reactor.

Such a processing system in accordance with one embodiment includes a staged fluidized bed reactor wherein a carbonaceous fuel and an oxygen-containing gas are eluted through a fluidized bed comprising an inert material, dolomite or a combination thereof. The staged fluidized bed reactor includes at least three reaction zones, each reaction zone operating at a different selected pressure. The distribution system includes at least three hoppers. Each of the hoppers is in material transfer communication with an associated selected one of the reaction zones. Each of the hoppers is provided with a plurality of outlet orifices. Each of the outlet orifices is adapted to flow therethrough a combination of gas and the carbonaceous fuel to pneumatically convey the carbonaceous fuel to a distribution manifold. Each of the hoppers provides the combination of gas and carbonaceous fuel to the distribution manifold at a different selected pressure. The distribution manifold serves to distribute an even flow of the carbonaceous fuel over an extended distribution area within the associated selected one of the reaction zones. The distribution manifold includes a plurality of tubes with each tube having a plurality of exit orifices wherein each tube carries a portion of the combination of the gas and the carbonaceous fuel in an equal amount and wherein each exit orifice passes an equal portion of the combination of the gas and the carbonaceous fuel.

In accordance with another aspect of the subject development, there is provided a method for evenly distributing a granular carbonaceous fuel material within a staged fluidized bed reactor. In the reactor, the granular carbonaceous fuel and an oxygen-containing gas are eluted through a fluidized bed containing an inert material, dolomite or a combination thereof. The staged fluidized bed reactor includes at least three reaction zones, each reaction zone operating at a different selected pressure. In accordance with one embodiment, the method involves pneumatically conveying an equal amount of gas and the granular carbonaceous fuel material through a specified distribution manifold. More particularly, the distribution manifold desirably includes a plurality of tubes, each tube including a plurality of orifices with each of the orifice flowing an equal amount of gas and granular carbonaceous fuel material.

As used herein, references to passage, distribution and the like of "equal" or "even" amounts or portions are to be understood as referring to such passage, distribution and the like of amounts or portions that are generally within ±30% of each other, and preferably within ±10% of each other.

Other objects and advantages will be apparent to those skilled in the art from the following detailed description taken in conjunction with the appended claims and drawings.

DETAILED DESCRIPTION OF THE INVENTION

The subject development provides methods and devices for the even distribution of solid materials, particularly fuel material solids such as carbonaceous fuel solids (e.g., coal, petroleum coke, biomass and the like) such as of granular form, over extended areas such as, in particular, in or within a pressurized oxy-combustion fluidized bed reactor.

Methods and devices for distributing solid materials, particularly fuel material solids such as carbonaceous fuel solids such as of granular form, evenly in accordance with the subject development are described in greater detail below making specific reference to oxy-combustion processing and coal burning power plants, those skill in the art and guided by the teachings herein provided will, however, understand and appreciate that the broader application of the methods and devices herein described can find suitable application in a variety of contexts and in the processing of various materials wherein even distribution of solid materials, particularly fuel material solids such as carbonaceous fuel solids such as of granular form over extended areas is sought, desired and/or is beneficial.

To best achieve the greatest benefits of pressurized oxy-combustion in a fluidized bed, the fuel is desirably distributed at multiple levels within the bed, in order to allow staged combustion. The pressure will be different at different stages, therefore for a three stage fuel injection system, three fuel injector systems operating at different corresponding pressures would desirably be employed.

The ideal spacing of injectors is generally a trade-off between the cost of multiple fuel splits from a single hopper (which can be expensive based on the cost of equipment and compressed gas) versus the potential for chemical damage to components close to the fuel injector from either high temperatures, corrosion from unpredictable oxygen depleted or sulfur rich environments, or all of these things. Desired injector density can be based on empirical data such as from previously tested pressurized fluidized bed combustors (PFBC's).

Figure 1:
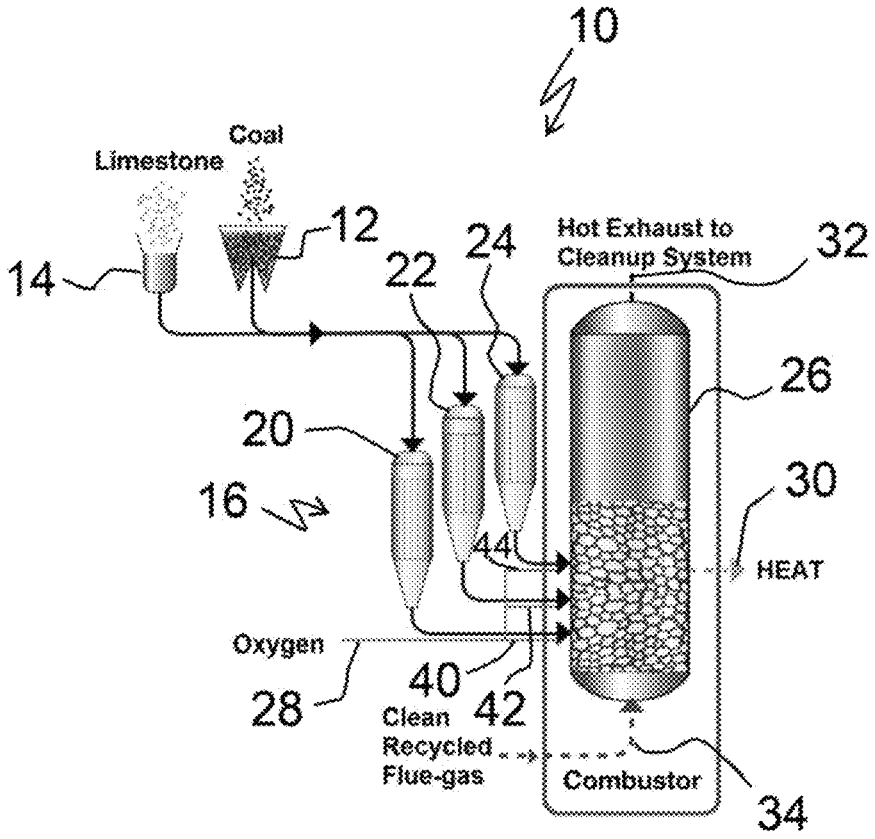
FIG. 1 is a simplified schematic diagram of a processing system in accordance with one aspect of the subject development.

FIG. 1 is a simplified schematic diagram of a processing system, generally designated by the reference numeral 10, in accordance with one aspect of the subject development. In the processing system 10, a solids material, such as fuel material solids such as carbonaceous fuel solids such as coal and such as of granular form is fed from a reservoir 12 and limestone from a reservoir 14 into a feed hopper arrangement 16 such as composed of three feed hoppers 20, 22, and 24.

As described in greater detail below, the feed hoppers 20, 22, and 24 serve to introduce the fuel material into an oxy-combustion reactor 26 in accordance with one aspect of the subject development. Oxygen is also introduced into the oxy-combustion reactor 26 such as via a line 28.

The oxy-combustion reactor 26 can desirably serve to produce heat, such as represented by a line 30, and such as may be used to produce or generate electricity or power, such as is known in the art. The oxy-combustion reactor 26 also forms or produces hot exhaust or flue gases such as $CO_2$, $H_2O$ (e.g., steam) and others, such as represented by a line 32, and such as may be further treated or processed, as may be desired. In the processing system 10, at least a portion of the reactor system flue gases, such as after appropriate recovery processing, is recycled back to the oxy-combustion reactor 26 system such as represented by the line 34.

As will be appreciated by those skilled in the art and guided by the teachings herein provided, advantageously the fuel and oxygen are injected in close proximity to each other. For example, as disclosed in related and herein incorporated U.S. patent application Ser. No. 15/235,619, filed on 12 Aug. 2016, such sufficiently close proximity desirably produces, results or leads to devolatization burning (e.g., devolatization referring to the hydrocarbon content of the fuel) taking place prior to oxygen depletion via mixing, such that no reducing atmospheres will be produced at that location. To that end, FIG. 1 depicts the oxygen feed line 28 branching to form oxygen feed lines 40, 42, and 44 for introducing oxygen into the oxy-combustor reactor 26 in appropriate proximity to introduction of fuel from the feed hoppers 20, 22, and 24, respectively.

While the illustrated feed hopper arrangement is shown as including three feed hoppers 20, 22, and 24, those skilled in the art will understand and appreciate that the number of feed hoppers can be appropriately selected to appropriately optimize system processing.

Figure 2:
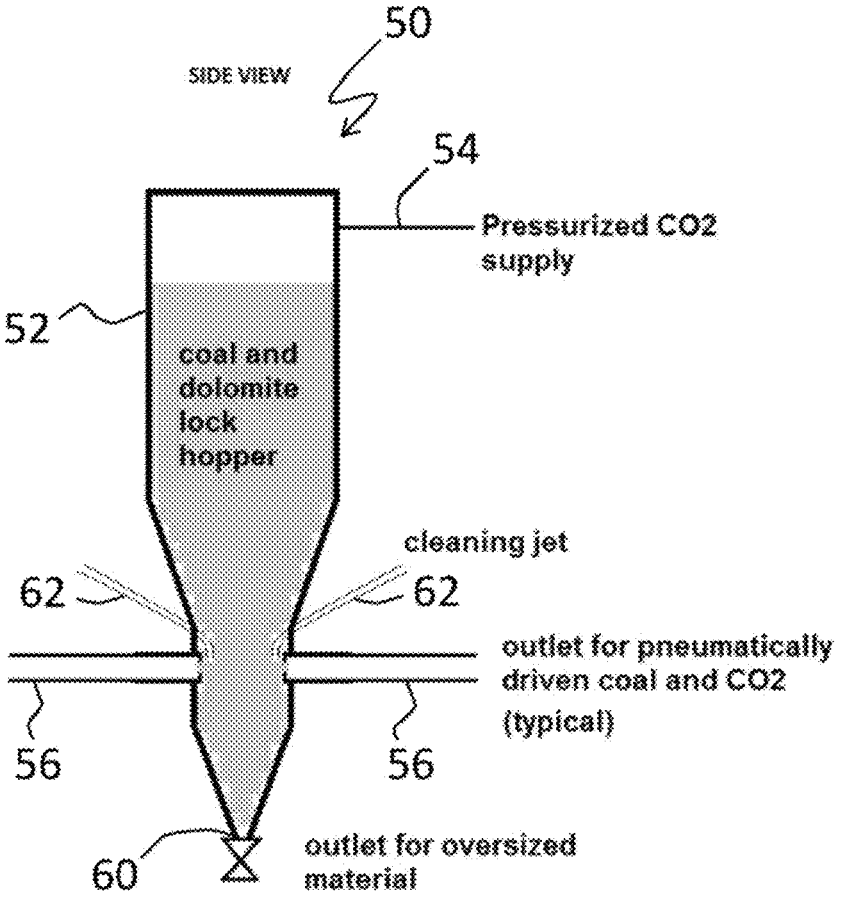
FIG. 2 is a simplified schematic side view of a material distribution hopper assembly in accordance with one aspect of the development.
Figure 3:
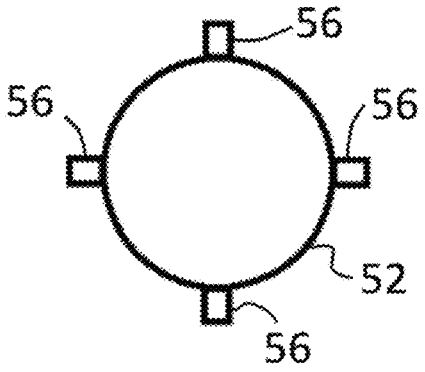
FIG. 3 is a simplified top view of the material distribution hopper shown in FIG. 2.

Turning to FIG. 2 these is illustrated a simplified schematic side view of a material distribution hopper assembly, generally designated by the reference numeral 50, in accordance with one aspect of the development. The material distribution hopper assembly 50 includes a material distribution hopper 52, with FIG. 3 showing a top view of the hopper 52.

The material distribution hopper 52 is desirably pressurized to approximately 20-30% higher pressure than the receiving combustor with a delivery gas comprised of $CO_2$, such as shown as being introduced into the hopper via a line 54. The material distribution hopper 52 includes a plurality of outlet orifices 56 adapted to flow therethrough a combination of gas and the solid fuel material to appropriately pneumatically convey the solid fuel material to the associated oxy-combustion reactor.

The only time gas must be introduced at the bottom of the hopper 52 is during start-up, to fluidize the material for initial flow establishment. That fluidizing flow may be introduced tangentially or radially rather than axially. Once solid flow is established, this fluidizing flow may be turned off. A port 60 can desirably be provided at or near the bottom of the hopper 52 such as to facilitate or permit removal of oversized material. Jets 62 can desirably be positioned or placed next to each orifice 56 in case oversize material plugs the orifice.

While the illustrated embodiment is shown as having or including four generally equally spaced apart outlet orifices 56 distributed around the hopper 52, those skilled it the art and guided by the teachings herein provided will understand and appreciate that the broader practice of the subject development is not necessarily so limited. Thus, in specific embodiments, hoppers for use in the practice of the subject development can include 2, 3, 4, 5 or more outlet orifices, as may be desired for a particular application.

Figure 4:
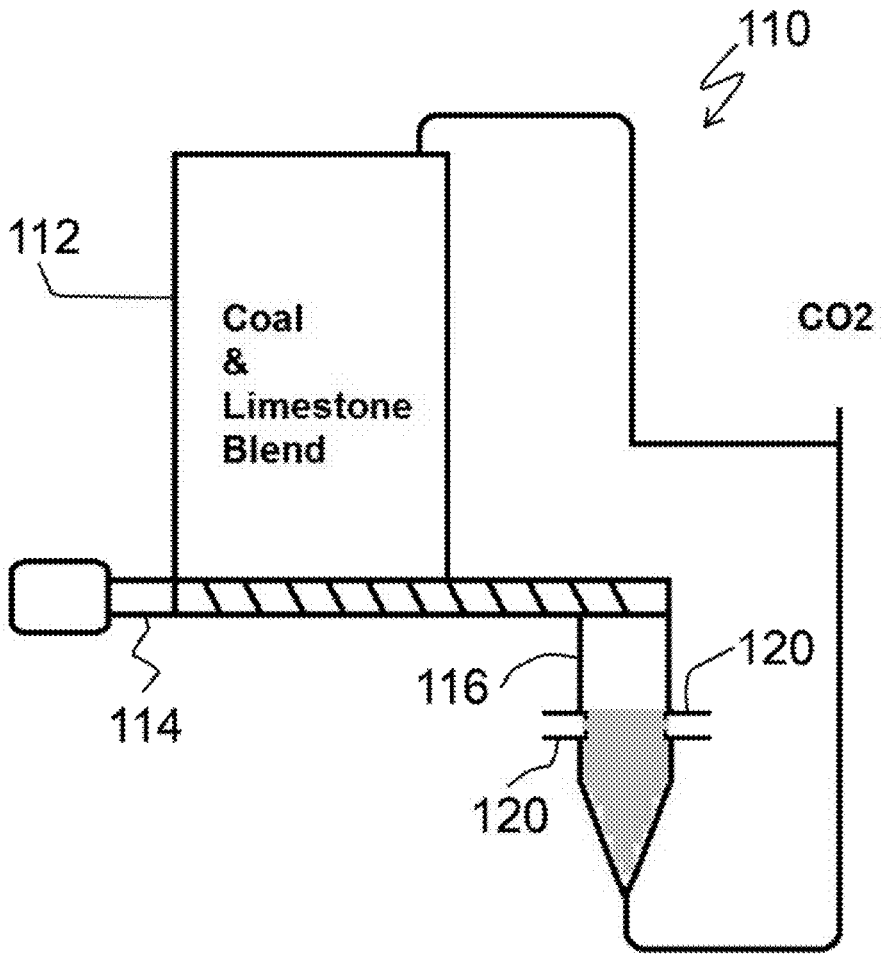
FIG. 4 is a simplified schematic of a solids feed system such as for use in accordance with one embodiment of the subject development.

Turning to FIG. 4, there is illustrated a simplified schematic of a solids feed system, generally designed by the reference numeral 110, such as for use in accordance with one embodiment of the subject development.

More specifically, FIG. 4 illustrates the solids feed system 110 employing a CO2 delivery gas being introduced into a coal and limestone blend reservoir 112 such as to be conveyed via an auger 114 to a material distribution hopper 116 such as described above and such as having a plurality of outlet orifices 120. In this embodiment of the solids feed system 110, the $CO_2$ can desirably serve to pressurize both the feed reservoir 112 and the material distribution hopper 116 such as located downstream of the auger and where the coal and $CO_2$ would be split into a plurality of streams. Thus, as shown, a single auger can desirably serve to feed or result in a plurality of streams.

Figure 5:
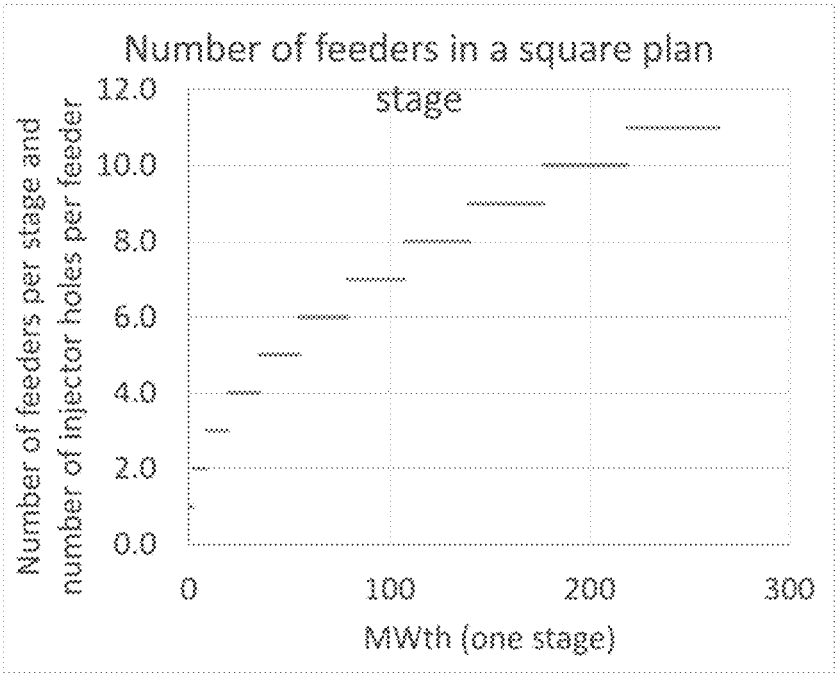
FIG. 5 is a graphical presentation of the number of feeders in a square plan stage in accordance with one aspect of the development.

FIG. 5 is a graphical presentation of the number of feeders in a square plan stage and permits a determination of the required number of separate orifices in accordance with one aspect of the development.

More particularly, the graph shown in FIG. 5 is primarily based on the following: The number of injectors per square meter may be 1.2 to 4.8, preferably 3 to 4. The number of megawatts thermal per square meter may be 4.7 to 8.3, preferably 6 to 7. The resulting minimum number of injectors is shown in the graph for a square plan area, which is designed to have a perfect square integer number of injectors (4, 9, 16, 25, 36 etc.). These sizing parameters may be used to also design hexagonal or octagonal distribution systems with similar densities which fit more compactly into a round pressure vessel. In accordance with one preferred aspect of the subject development, an optimal fuel flow per injector is approximately 6.5/3.5=1.8 MWth, but more uniform distributions may be realized with injector spacings providing or resulting in 1 MWth/injector. As will be appreciated by those skilled in the art and guided by the teachings herein provided, desired injector spacing and optimization can become an economic decision for cost of injector fabrication.

Figure 6:
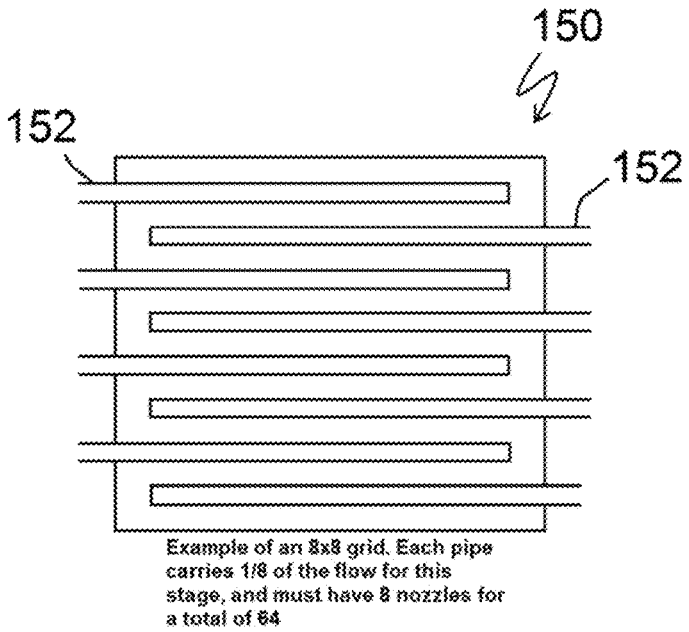
FIG. 6 is a simplified schematic showing an 8×8 distribution system in accordance with one embodiment of the development.

Turning to FIG. 6 there is shown a simplified schematic of an 8×8 solid feed distribution system, generally designated by the reference numeral 150, in accordance with one aspect of the development. The distribution system 150 includes a plurality of distribution tubes 152 with each tube having a plurality of exit orifices (not here specifically shown) wherein each tube carries a portion of the combination of the gas and the carbonaceous fuel in an equal amount and wherein each exit orifice passes an equal portion of the combination of the gas and the carbonaceous fuel. In this particular illustrated embodiment, the distribution tubes 152 are shown as being in a general parallel alternating arrangement extending across the grid. Those skilled in the art and guided by the teachings herein provided will understand and appreciate that other suitable distribution systems can be employed and the broader practice of the subject development is not necessarily limited to a specific or particular distribution system arrangement.

Once the number of injectors is determined, the total stage MW is divided by the number of injectors to determine the amount of fuel which must be delivered per manifold feeder. When this is determined, the feeders can be sized according to the fuel flow, as shown in FIG. 7.

Figure 7:
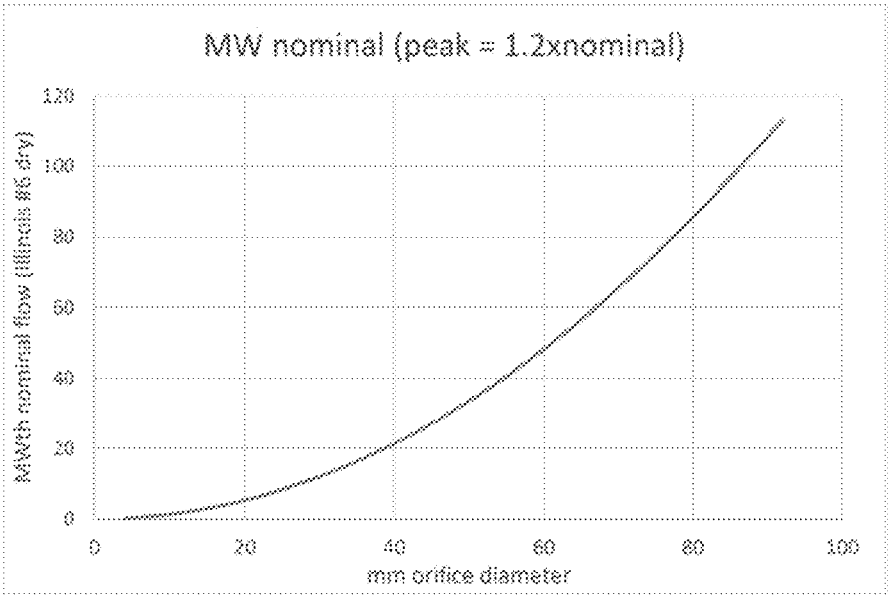
FIG. 7 is a graphical presentation of nominal flow rates versus orifice diameters to permit sizing of feeders according to fuel flow in accordance with one aspect of the development.

The line shown in the FIG. 7 graph is based on a nominal coal flow of 2.4 kg/hr/m$^2$ with the assumption of 12% by weight addition of dolomite for sulfur retention. Different sulfur contents and different Ca/S ratios required for sulfur capture may alter this calculation, but the curve will provide a useful minimum orifice size which still has margin for higher flow rate. The shown curve is based on Illinois #6 coal. Coals with different heating value may require more or less flow to compensate as those skilled in the art and guided by the teachings herein provided will understand and appreciate.

Figure 8:
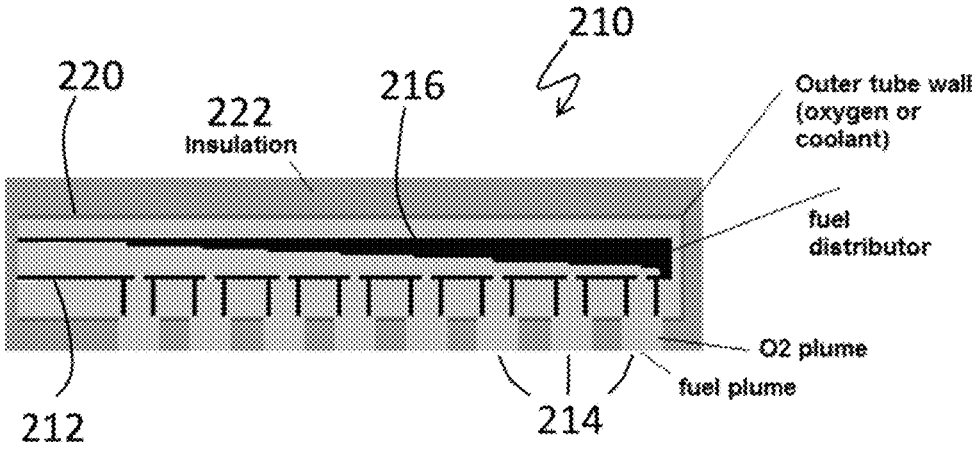
FIG. 8 is a simplified schematic of a material flow distributor in accordance with one aspect of the development.

FIG. 8 illustrates a material flow distributor, generally designated by the reference numeral 210, in accordance with one aspect of the development. The illustrated material flow distributor 210 can be made simply, including steps and particle trips, using additive manufacturing methods, and then can be readily welded into long tube manifolds using normal pipe welding methods. The material flow distributor 210 includes a central pipe 212 such as to serve to carry the solid, carbonaceous fuel and includes a succession of exit orifices 214. In one preferred embodiment, such as shown, each successive manifold exit orifice 214 is followed by a flow area reduction 216 such that the velocity of the material passing through the pipe is desirably held constant.

Tabs may be appropriately placed prior to on the opposite wall to force some particles to leave the tube, and corners may be built-up to resist erosion. Manifold arrangements of such flow distributors can desirably be placed from opposite ends as shown previously to make up for possible maldistribution along the length. The design shown can easily be inserted from one end because it has the same OD along its length.

In one preferred embodiment, each distributor will feed the same number of orifices inside the fluidized bed. As such distributors may typically be relative small in diameter, in one preferred embodiment, the distributors are actively cooled to prevent the coal from plugging the lines. Thus, for example, a double lined pipe with a coolant, e.g., water, in the annulus 220 will perform this function. Oxygen may also be used for this purpose if the pipe and flow are large enough, but water and/or the addition of insulation 222 may still be required. Oxygen so delivered can be injected with the fuel to provide or result in desired even distribute.

Figure 9:
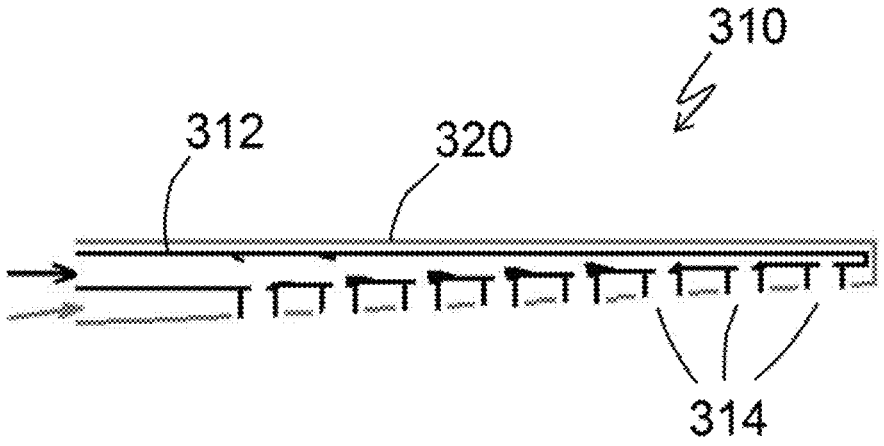
FIG. 9 is a simplified schematic of a material flow distributor in accordance with another embodiment of the development.

FIG. 9 illustrates a material flow distributor, generally designated by the reference numeral 310, in accordance with another embodiment of the development. Similar to the material flow distributor 210 described above, the material flow distributor 310 includes a conduit or pipe 312 such as to serve to carry the solid, carbonaceous fuel and includes a succession of exit orifices 314. In one preferred embodiment, such as shown, the conduit or pipe 312 is tapered or generally narrows after each successive exit orifice 314 such that the velocity of the material passing through the conduit is desirably held constant.

If desired, such a distributor can also be similarly actively cooled to prevent the coal from plugging the lines. Thus, for example, a double lined pipe with a coolant, e.g., water, in the annulus 320 will perform this function. Oxygen may also be used for this purpose if the pipe and flow are large enough, but water and/or the addition of insulation may still be required.

Figure 10:
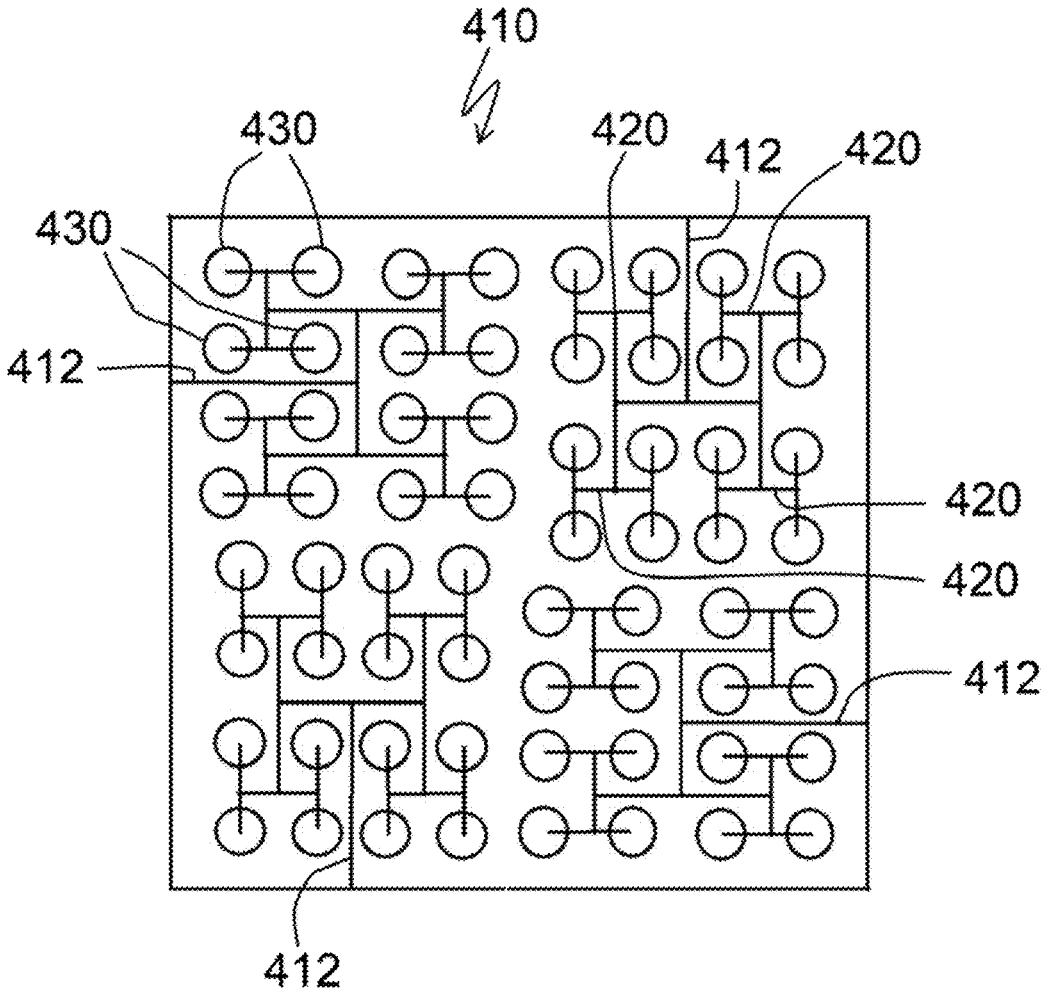
FIG. 10 is a simplified schematic showing a distribution system in accordance with another embodiment of the development.

FIG. 10 is a simplified schematic showing a distribution system 410 in accordance with another embodiment of the development. More particularly, the distribution system 410 employs four distributors 412, each distributor branching off to form four pods 420 each having or forming four outlets 430 so as to provide or result in equal splitting and distribution of fuel material within a horizontal section of the combustor.

Those skilled in the art and guided by the teachings herein provided will understand and appreciate that many additional different distribution arrangements for equally and evenly distributing the fuel material within are possible and that the broader practice of the subject development is not necessarily limited by or to the distribution systems shown and described herein.

The claims are not intended to include, and should not be interpreted to include, means-plus- or step-plus-function limitations, unless such a limitation is explicitly recited in a given claim using the phrase(s) "means for" or "step for," respectively.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A processing system comprising:

a staged fluidized bed reactor wherein a carbonaceous fuel and an oxygen-containing gas are eluted through a fluidized bed comprising an inert material, dolomite or a combination thereof, wherein the staged fluidized bed reactor includes at least three reaction zones, each reaction zone operating at a different selected pressure; and a distribution system for even distribution of the carbonaceous fuel to the staged fluidized bed reactor, the distribution system including:

at least three hoppers, each of said hoppers in material transfer communication with an associated selected one of said reaction zones, each of said hoppers provided with a plurality of outlet orifices, each of said outlet orifices adapted to flow therethrough a combination of gas and the carbonaceous fuel to pneumatically convey the carbonaceous fuel to a distribution manifold, wherein each of said hoppers provides the combination of gas and carbonaceous fuel to the distribution manifold at a different selected pressure; and the distribution manifold to distribute an even flow of the carbonaceous fuel over an extended distribution area within the associated selected one of said reaction zones, the distribution manifold comprising a plurality of tubes with each tube having a plurality of exit orifices wherein each tube carries a portion of the combination of the gas and the carbonaceous fuel in an equal amount and wherein each exit orifice passes an equal portion of the combination of the gas and the carbonaceous fuel.

2. The system of claim 1 wherein the carbonaceous fuel is selected from the group consisting of coal, petroleum coke and biomass.

3. The system of claim 1 wherein the carbonaceous fuel is in a granular form.

4. The system of claim 1 additionally comprising an auger to mechanically meter the carbonaceous fuel to form a plurality of feed streams.

5. The system of claim 1 wherein the carbonaceous fuel is coal.

6. The system of claim 1 wherein the carbonaceous fuel is petroleum coke.

7. The system of claim 1 wherein the carbonaceous fuel is biomass.

8. A method for evenly distributing a granular carbonaceous fuel material within a staged fluidized bed reactor with the processing system of claim 1, said method comprising:

pneumatically conveying an equal amount of gas and the granular carbonaceous fuel material through the distribution manifold.

9. The method of claim 8 wherein the granular carbonaceous fuel is selected from the group consisting of coal, petroleum coke and biomass.

10. The method of claim 8 wherein the granular carbonaceous fuel material is distributed to the staged fluidized bed reactor via the distribution system wherein each of said hoppers provides the combination of gas and granular carbonaceous fuel to the distribution manifold at a different selected pressure.

11. The method of claim 8 additionally comprising;

mechanically metering the granular carbonaceous fuel via an auger to form a plurality of feed streams.

12. The method of claim 8 wherein the granular carbonaceous fuel is coal.

13. The method of claim 8 wherein the granular carbonaceous fuel is petroleum coke.

14. The method of claim 8 wherein the granular carbonaceous fuel is biomass.

* * * * *